United States Patent [19]

Griffin et al.

[11] Patent Number: 4,711,151

[45] Date of Patent: Dec. 8, 1987

[54] MISSILE LAUNCHER

[75] Inventors: Dennis Griffin, Guildford; Charles A. Field, Kingston-upon-Thames, both of England

[73] Assignee: Frazer-Nash Ltd., Surrey, England

[21] Appl. No.: 824,559

[22] Filed: Jan. 23, 1986

[30] Foreign Application Priority Data

Oct. 30, 1984 [GB] United Kingdom ..... 8427444

[51] Int. Cl.[4] ..... F41F 3/04

[52] U.S. Cl. ..... 89/1.805; 89/1.815; 89/1.819

[58] Field of Search ..... 89/1.804, 1.815, 1.819

[56] References Cited

U.S. PATENT DOCUMENTS

| | | | |
|---|---|---|---|
| 3,276,317 | 10/1966 | Kossan et al. | 89/1.7 |
| 3,316,808 | 5/1967 | Mais | 89/1.804 |
| 3,771,416 | 11/1973 | Ackerman | 89/1.819 X |
| 3,861,272 | 1/1975 | Koepfer | 89/1.819 X |
| 3,865,009 | 2/1975 | Kongelbeck | 89/1.815 |
| 3,967,529 | 7/1976 | Ingle et al. | 89/1.819 |
| 4,256,012 | 3/1981 | Cowart et al. | 89/1.819 X |
| 4,471,684 | 9/1984 | Johnson et al. | 89/1.815 |
| 4,494,438 | 1/1985 | Lighton et al. | 89/1.819 X |
| 4,660,456 | 4/1987 | Griffin et al. | 89/1.819 |

*Primary Examiner*—Peter A. Nelson

*Attorney, Agent, or Firm*—Hall, Myers & Rose

[57] ABSTRACT

An airborne missile launcher is provided which is of modular construction to carry a variety of different missiles. A main body section has top attachment points, whereby it is carried by an aircraft, and a sub-rail hanger releasably attached at its underside which sub-rail preferably has a plurality of longitudinal tracks for carrying several different types of missile. To complete the launcher body, forward and aft body sections are attached to the main body section, each of which forward and aft body sections can be selected from a number of different such sections to suit different types of missile. The launcher also includes a nitrogen bottle carried right forward in a detachable fairing, a chaff dispenser carried aft, hold-back shoes to enable missile power up prior to translation relative to the sub-rail and convex bulged sides to reduce vertical stiffness and vibrations. For certain missile types, the forward or aft section may be simply a plastics fairing; for certain other missile types, the forward or aft section may house a missile umbilical retraction mechanism and other operative means.

10 Claims, 12 Drawing Figures

MISSILE LAUNCHER

This invention relates to missile launchers and, more particularly, launchers of the fixed body rail type to be borne by aircraft.

With this type of launcher the propulsion motor of the missle is ignited to initiate launch and when the missile motor thrust has built up to a certain value a release mechanism operates automatically, as a consequence of that thrust, allowing the missle to leave the launcher by being propelled forward along the launcher rail. Until the missile is launched an umbilical connection must be maintained between the aircraft and the missile, via the launcher body. Since different missiles have different lengths, different arrangements of suspension hooks and different positioning of the umbilical connection along the missile body, each design of launcher has hitherto been capable of carrying only one type, or exceptionally two types, of missile, and has commonly needed to be of a length that is substantially the same as or a major proportion of the length of the longest missile to be carried.

It is an object of the present invention to improve considerably on this situation by providing a launcher that can be adapted to carry a number of different types of missile and yet involves lower weight, size and drag penalties than existing launchers.

According to the invention, the missile launcher is of modular construction comprising:

The invention, in summary, contemplates an airborne missile launcher including a main module, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and first member of a third cooperating attachment element proximate to said second surface said main body further adapted to receive a nose section and a tail section to complete the body length. Also included are a forward module, comprising a nose section and a second member of the first attachment element which cooperates with the first member to connect the nose section to the main body section in a manner where the nose section is releasably affixed to the first end of the main body section; an aft module, comprising a tail section and a second member of the second attachment element which cooperates with the first member to connect the tail section to the main body section in a manner where the tail section is releasably affixed to the second end of the main body section; and a sub-rail adapted to carry a missile and a second member of the third attachment element which cooperates with the first member to connect the sub-rail to the main body section in a manner where the sub-rail is releasably attached to said main body section. Additional features, some individually or in combination with those set forth above, are sub-rail locking means, retracting means for a missile umbilical connection; retraction means for missile striker points; retractable missile hook snubbers; a nitrogen bottle with a nitrogen supply regulator carried right forward of said main body section; extendible hold-back shoes to allow for missile power up prior to translation along the sub-rail; and convex bulged main module sides to decrease vertical stiffness and promote vibration absorption.

The sub-rail may be removable attached to main body by means of fir trees or T-slots, and locked by a withdrawable plunger, and preferably it has a plurality of longitudinal guide tracks to receive the suspension hooks of different types of missile.

The invention will be more fully understood from the following description of one embodiment thereof, given by way of example and with reference to the accompanying drawings.

FIGS. *2a* through *2e* together comprise a segmented cut-away side view of the missile launcher according to this invention in a continuous manner from FIG. *2a* representing the forward portion of the launcher to FIG. *2e* representing the aft portion.

Figure 3:
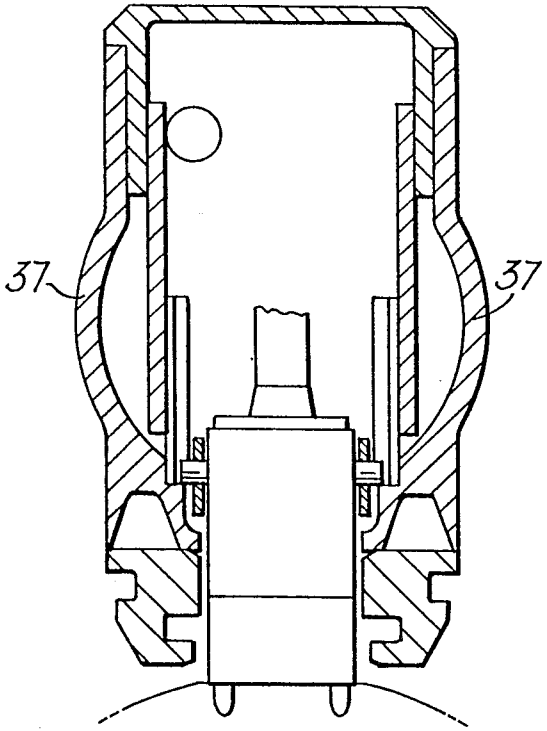

FIG. 3 is a cross-sectional view taken along line G/G in FIG. *2b*.

Figure 1:
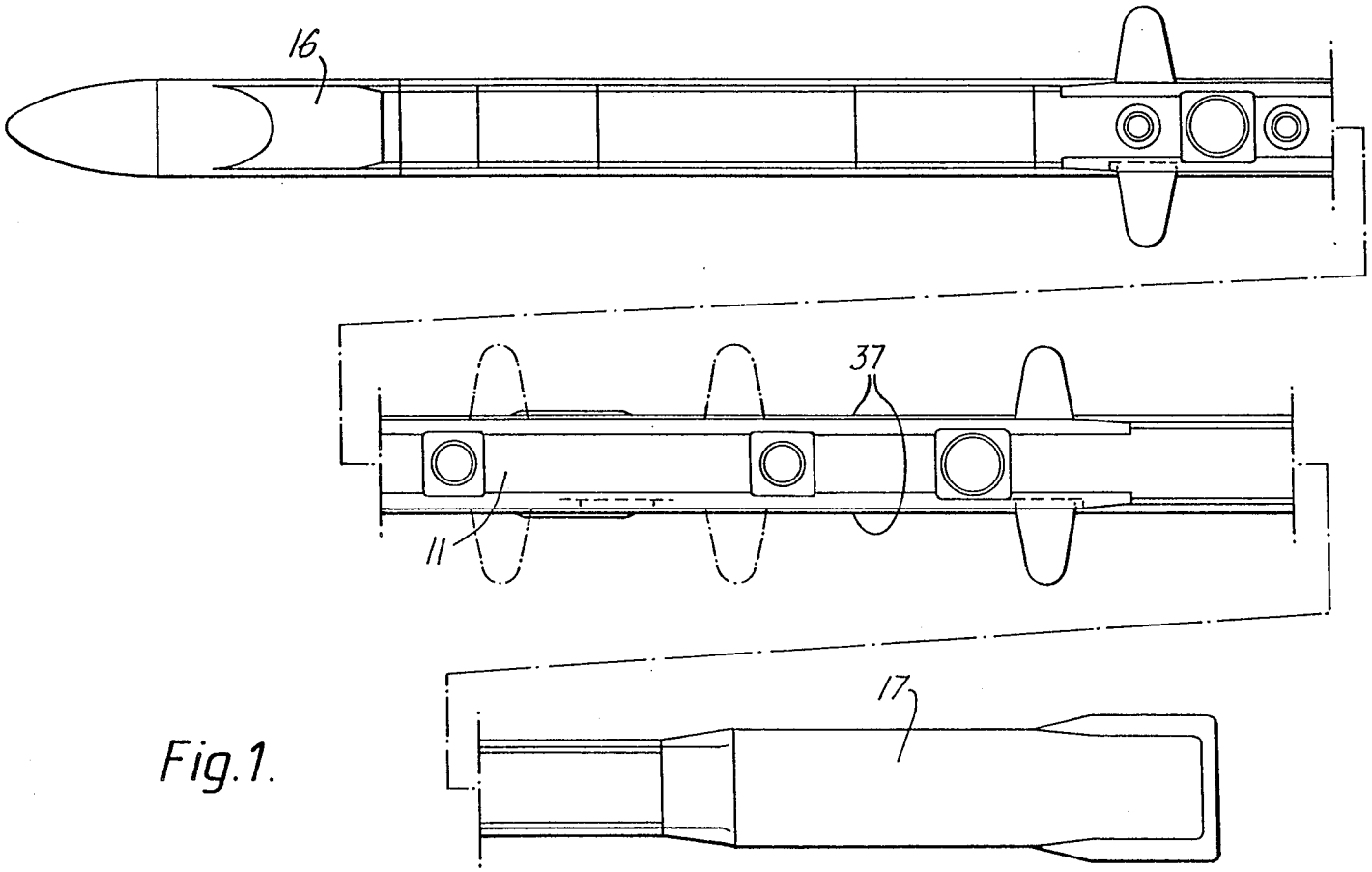
FIG. 1 is a segmented bottom view of the missle launcher according to the invention.
Figure 2A:
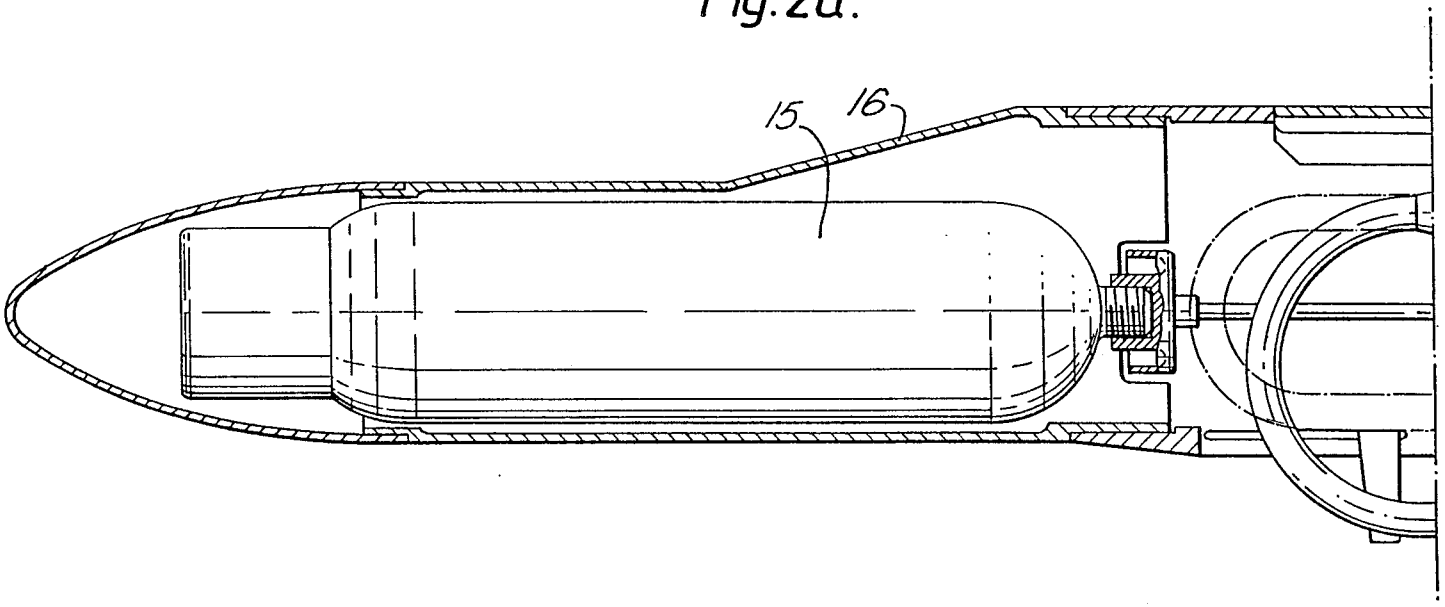
Figure 2B:
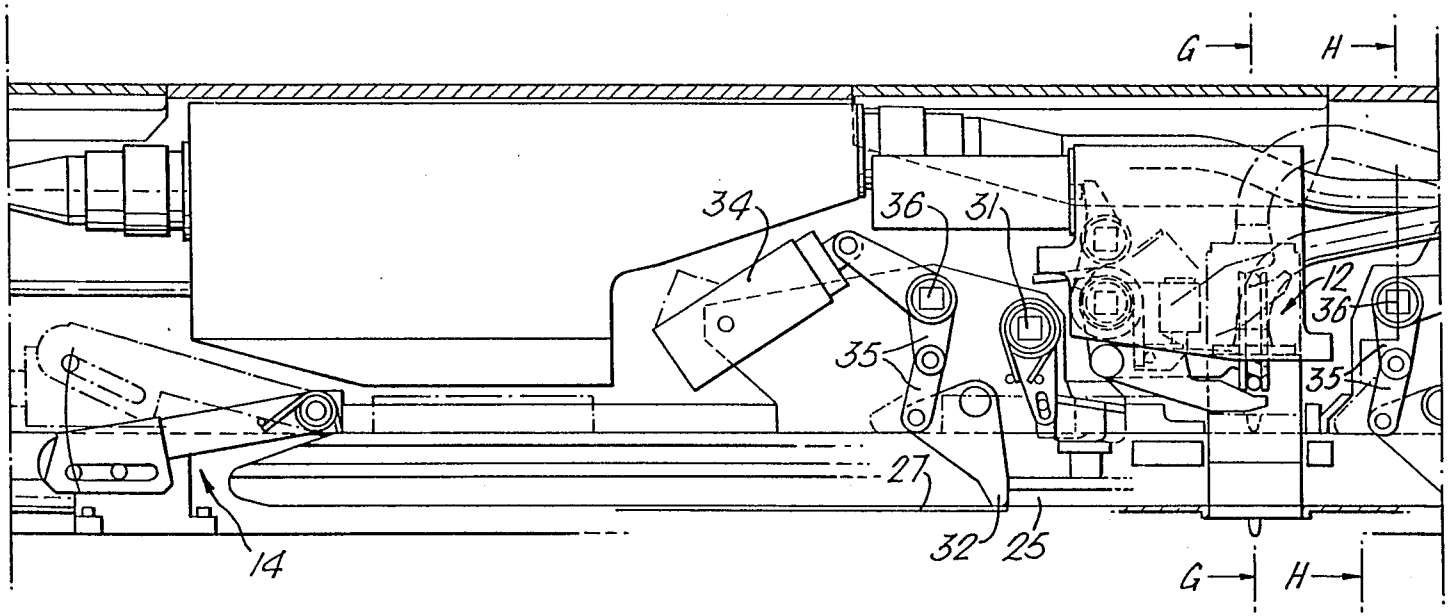
Figure 2C:
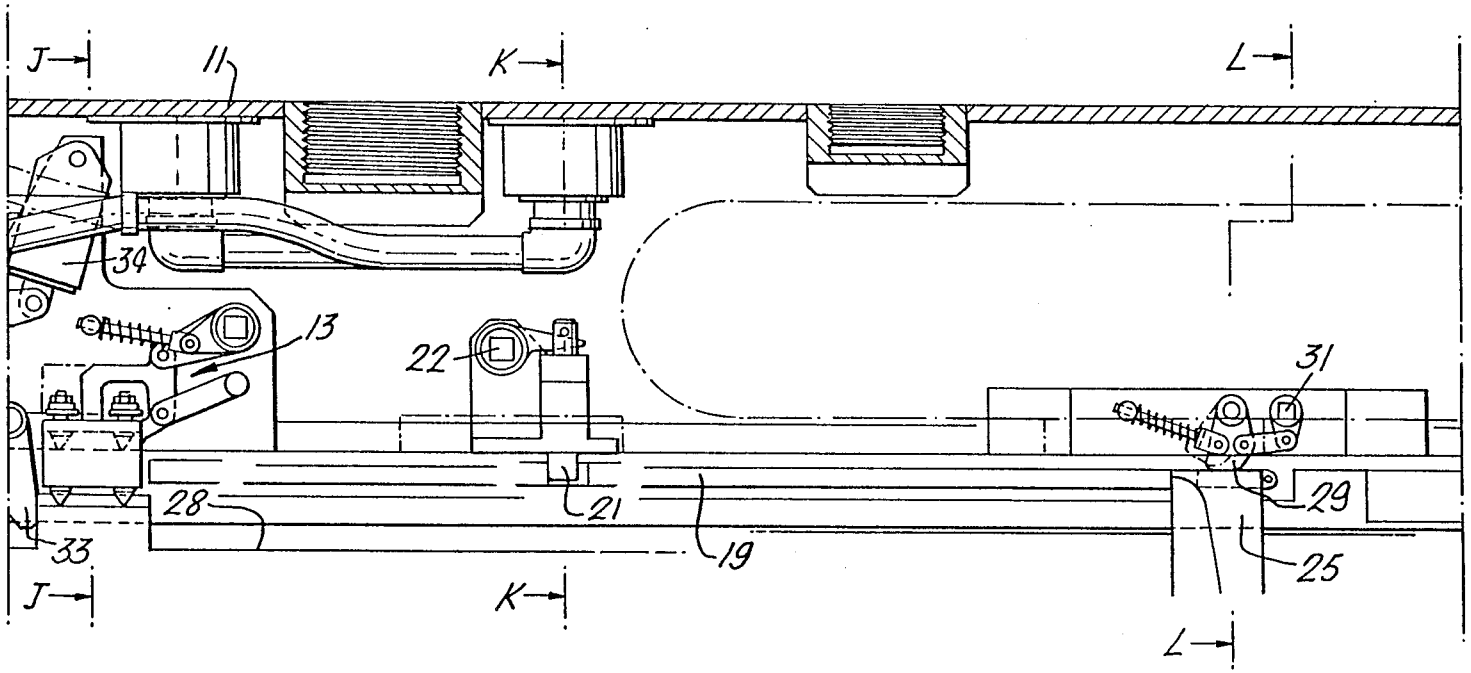
Figure 2D:
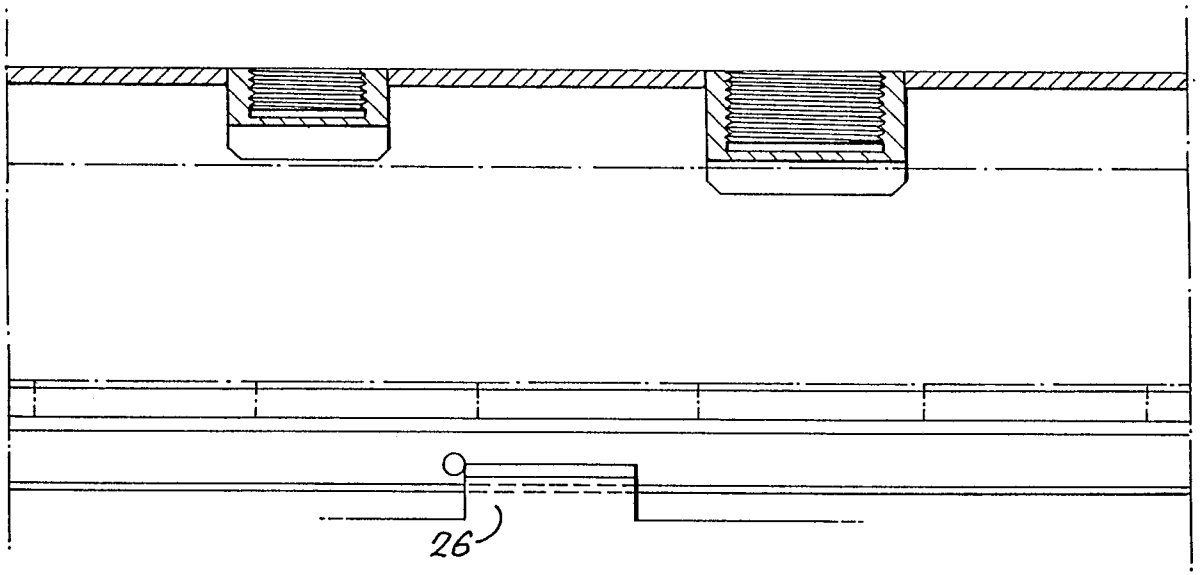
Figure 2E:
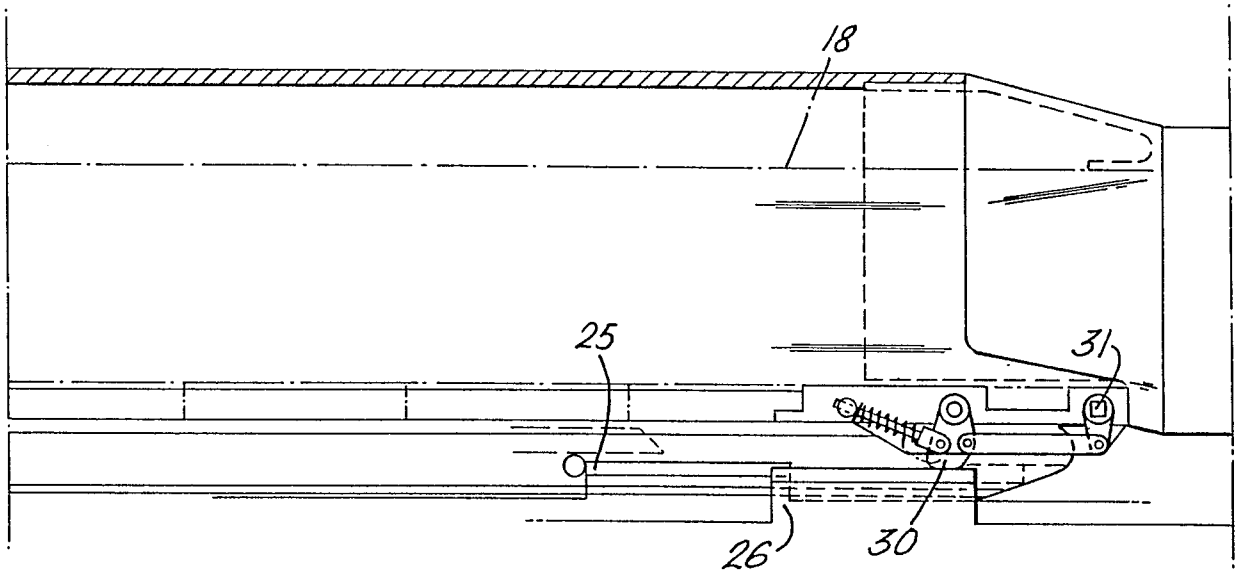
Figure 2F:
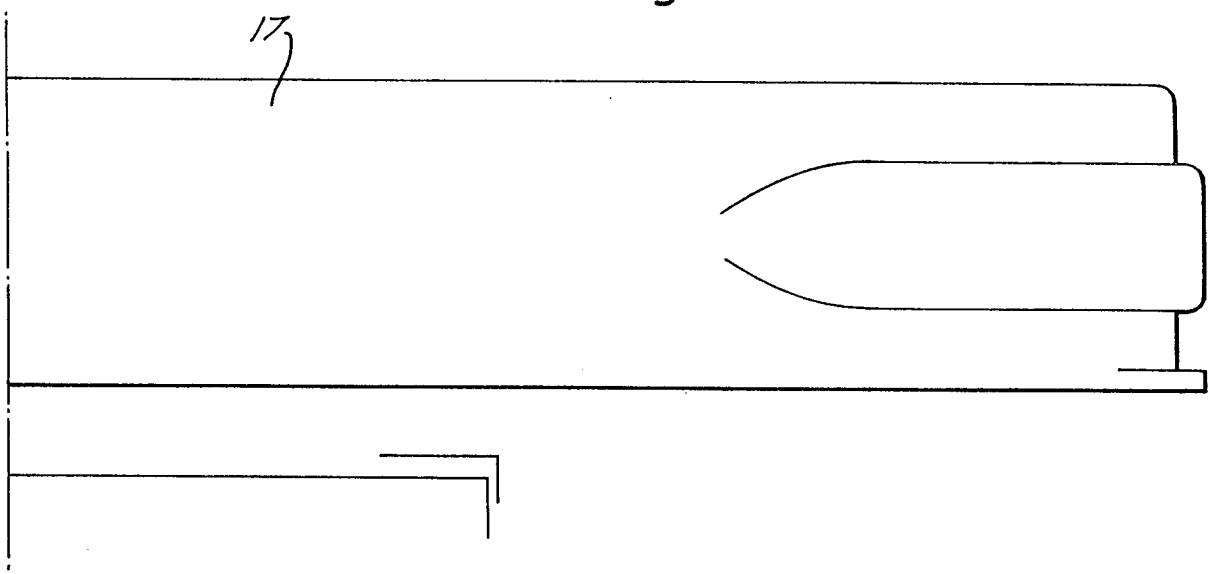
Figure 4:
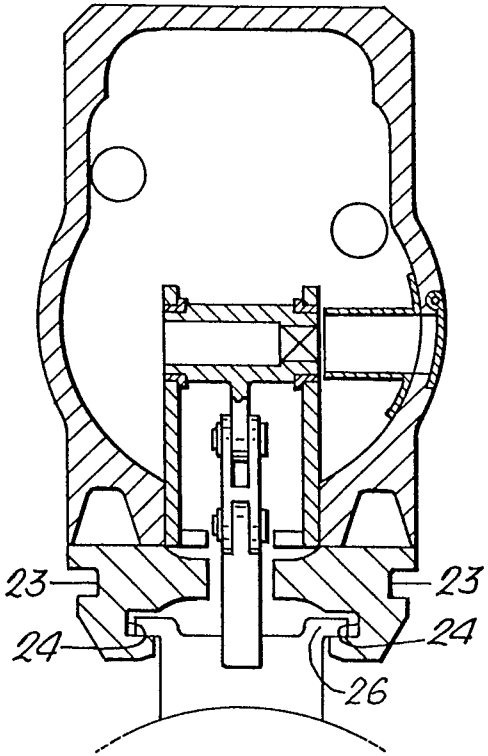

FIG. 4 is a cross-sectional view of the launcher taken alng line H/H in FIG. *2b*.

Figure 5:
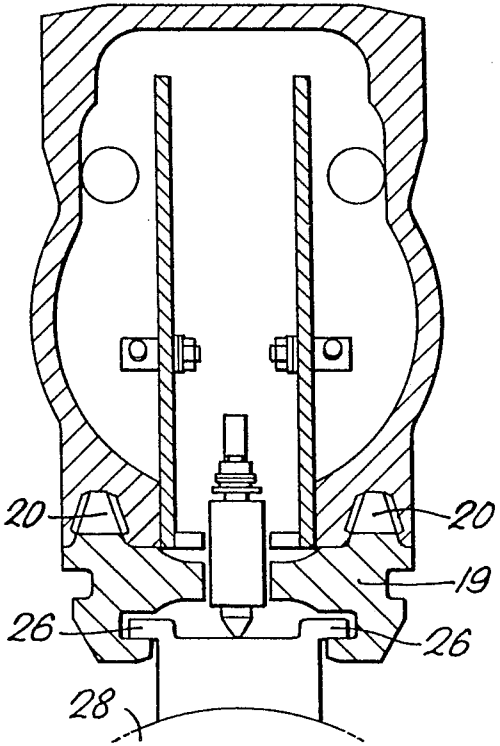

FIG. 5 is a cross-sectional view of the launcher taken along line J/J of FIG. *2c*.

Figure 6:
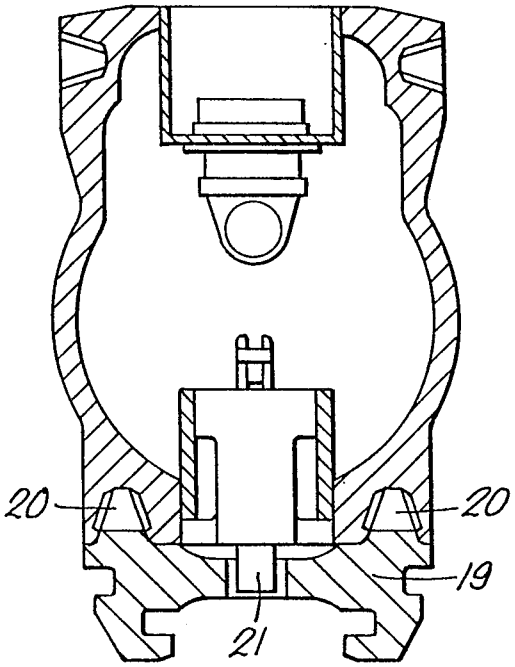

FIG. 6 is a cross-sectional view of the launcher taken along line K/K of FIG. *2c*.

Figure 7:
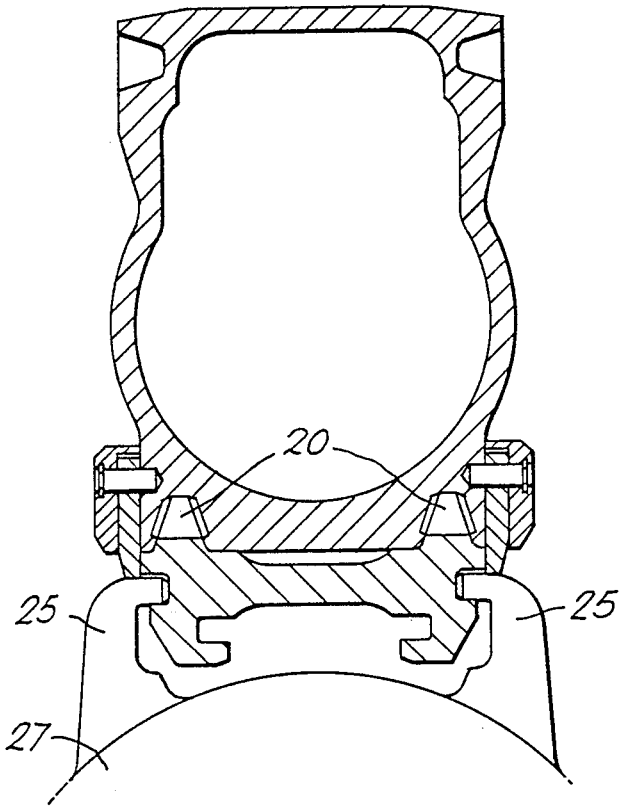

FIG. 7 is a cross-sectional view of the launcher according to this invention taken along line L/L of FIG. *2c*,

DETAILED DESCRIPTION OF THE INVENTION

The drawings show a rail launcher for carrying several different types of missile, such as Sidewinder and AMRAAM, and the general configuration of the main body of the launcher is similar to that described in our patent application No. 8326438 U.S. Pat. No. 4,660,456 Griffin et al) which is incorporated herein by reference. That is to say, the main body 11 contains mechanisms 12 and 13 for withdrawing the umbilical connection for the AMRAAM missile, and missile striker points for the Sidewinder, respectively, while forward there is a retraction mechanism 14 for the Sidewinder umbilical.

However, the nitrogen bottle 15 for the Sidewinder fuze is shown carried right forward in a detachable fairing 16 leaving clear the space inside the main body 11 occupied by this bottle in our previous arrangement. The aft end of the main body has been adapted to carry, if desired, a proprietary anti-radar chaff dispenser, such as that shown at 17 manufactured by Philips, and th8is dispenser has a long forward portion 18 which protrudes into the main body of the launcher to occupy the space formerly containing the nitrogen bottle. However, if the chaff dispenser is not fitted, the nitrogen bottle can be in the same position as before. Other items can also be attached to the rear end of the main body in place of the chaff dispenser.

Under the main body 11 is fitted the sub rail 19 which is attached by ten fir trees 20, or alternatively by T-slots. This rail is locked by a plunger 21 projecting down from the main body and withdrawable by turning a square-ended shaft 22. The rail 19 has outwardly and inwardly facing guide tracks 23, 24 to receive the suspension hooks 25, 26 of AMRAAM and Sidwinder missiles 27, 28. Spring-loaded snubbers 29, 30 are provided on the main body of the launcher to engage the hooks 25, 26 of the AMRAAM and Sidewinder missiles, respectively, all of which snubbers can be withdrawn manually by the turning of square-ended shafts 31. This enables the missile to be demounted on the ground.

Two hold-back shoes 32, 33 are provided for the AMRAAM and Sidewinder missiles, respectively, to enable the missile propulsion motor to power up before the missile is allowed to travel along the sub rail 19. The hold-back shoes are operated by respective solenoids 34 via toggle linkages 35, and each can be withdrawn by manually turning a square-ended shaft 36.

The sides of the main body 11 of the launcher have convex bulges 37, it having been found that by providing such bulges the vertical stiffness is reduced with the result that vibrations are beneficially absorbed.

We claim:

1. An airborne missile launcher of modular construction comprising:

(a) a main module, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(b) a forward module, comprising a nose seetion and a second member of the first attachment element which ccoperates with the first member to connect the nose section to the main body section in a manner where the nose section is releasably affixed to the first end of the main body section;

(c) an aft module, comprising a tail section and a second member of the second attachment element which cooperates with the first member to connect the tail section to the main body section in a manner where the tail section is releasably affixed to the second end of the main body section;

(d) a sub-rail adapted to carry a missile and a second member of the third attachment element which cooperates with the first member to connect the sub-rail to the main body section in a manner where the sub-rail is releasably attached to said main body section;

(e) sub-rail locking means;

(f) retracting means for a missile umbilical connection;

(g) retraction means for missile striker points;

(h) retractable missile hook snubbers; and (i) a nitrogen bottle with a nitrogen supply regulator carried right forward of said main body section.

2. An airborne missile launcher of modular construction comprising:

(a) a main module, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(b) a forward module, comprising a nose section and a second member of the first attachment element which cooperates with the first member to connect the nose section to the body section in a manner where the nose section is releasably affixed to the first end of the main body section;

(c) an aft module, comprising a tail setion and a second member of the second attachment element which cooperates with the first member to connect the tail section to the main body section in a manner where the tail section is releasably affixed to the second end of the main body section;

(d) a sub-rail adapted to carry a missile and a second member of the third attachment element which cooperates with the first member to connect the sub-rail to the main body section in a manner where the sub-rail is releasably attached to said main body section;

(e) a detachable fairing for attachment forward of said main body; and (f) a nitrogen bottle with a nitrogen supply regulator, said nitrogen bottle and supply regulator being contained within said detachable fairing.

3. A missile launcher according to claim 2 where the aft end of the main body section carries an anti-radar chaff dispenser.

4. An airborne missile launcher of modular construction comprising:

(a) a main module, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(b) a forward module, comprising a nose section and a second member of the first attachment element which cooperates with the first member to connect the nose section to the main body section in a manner where the nose section is releasably affixed to the first end of the main body section;

(c) an aft module, comprising a tail section and a second member of the second attachment element which cooperates with the first member to connect the tail section to the main body section in a manner where the tail section is releasably affixed to the second end of the main body section;

(d) a sub-rail adapted to carry a missile and a second member of the third attachment element which cooperates with the first member to connect the sub-rail to the main body section in a manner where the sub-rail is releasably attached to said main body section, hold-back shoes extendible from said body section to the missile being carried, actuating means for extending and retracting said hold back shoes, and linkages between said hold-back shoes and said actuating means where said hold-back shoes, when extended, contact the missile to enable the missile propulsion motor to power up before permitting translation of the missile relative to said sub-rail.

5. An airborne missile launcher according to claim 4 where said actuation means is a solenoid and said linkage is a pivotable toggle linkage.

6. An airborne missile launcher of modular construction comprising:

(a) a main module, comprising an intermediate main body section having first and second oppositely disposed surfaces, first and second oppositely disposed sides, and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length, said first and second sides, respectively, being convexly bulged to decrease vertical stiffness and promote vibration absorption;

(b) a forward module, comprising a nose section and a second member of the first attachment element which cooperates with the first member to connect the nose section to the main body section in a manner where the nose section is releasably affixed to the first end of the main body section;

(c) an aft module, comprising a tail section and a second member of the second attachment element which cooperates with the first member to connect the tail section to the main body section in a manner where the tail section is releasably affixed to the second end of the main body section; and (d) a sub-rail adapted to carry a missile and a second member of the third attachment element which cooperates with the first member to connect the sub-rail to the main body section in a manner where the sub-rail is releasably attached to said main body section.

7. Improvements in an airborne missile launcher of modular construction including:

(a) a main module, comprising an intermediate main body section having a first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(b) a forward module, comprising a nose section and a second member of the first attachment element which cooperates with the first member to connect the nose section to the main body section in a manner where the nose section is releasably affixed to the first end of the main body section;

(c) an aft module, comprising a tail section and a second member of the second attachment element which cooperates with the first member to connect the tail section to the main body section in a manner where the tail section is releasably affixed to the second end of the main body section; and (d) a bus-rail adapted to carry a missile and a second member of the third attachment element which cooperates with the first member to connect the sub-rail to the main body section in a manner where the sub-rail is releasably attached to said main body section, the improvement comprising:

(1) a detachable fairing for attachment forward of said main body, (2) a nitrogen bottle with a nitrogen supply regulator, said nitrogen bottle and supply regulator being contained within said detachable fairing.

8. Improvements in an airborne missile launcher of modular construction including:

(a) a main module, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(b) a forward module, comprising a nose section and a second member of the first attachment element which cooperates with the first member to connect the nose section to the main body section in a manner where the nose section is releasably affixed to the first end of the main body section;

(c) an aft module, comprising a tail section and a second member of the second attachment element which cooperates with the first member to connect the tail section to the main body section in a manner where the tail section is releasably affixed to the second end of the main body section; and (d) a sub-rail adapted to carry a missile and a second member of the third attachment element which cooperates with the first member to connect the sub-rail to the main body section in a manner where the sub-rail is releasably attached to said main body section, the improvement comprising:

hold-back shoes extendible from said main body section to the missile being carried, activity means for extending and retracting said hold-back shoes, and linkages between said hold-back shoes and said actuating means where said hold-back shoes, when extended, contact the missile to enable the missile propulsion motor to power up before permitting translation of the missile relative to the sub-rail.

9. Improvements in an airborne missile launcher of modular construction including:

(a) a main nodule, comprising an intermediate main body section having first and second oppositely disposed surfaces and first and second oppositely disposed ends said intermediate main body section usable with all the types of missile to be carried and of a length less than full body length, said main body being adapted for fixing to an aircraft along its first surface, said main body section having a first member of a first cooperating attachment element located proximate to said first end, a first member of a second cooperating attachment element located proximate to said second end and a first member of a third cooperating attachment element proximate to said second surface said main body further adapted to receive a nose section and a tail section to complete the body length;

(b) a forward module, comprising a nose section and a second member of the first attachment element which cooperates with the first member to connect the nose section to the main body section in a manner where the nose section is releasably affixed to the first end of the main body section;

(c) an aft module, comprising a tail section and a second member of the second attachment element which cooperates with the first member to connect the tail section to the main body section in a manner where the tail section is releasably affixed to the second end of the main body section; and (d) a sub-rail adapted to carry a missile and a second member of the third attachment element which cooperates with the first member to connect the sub-rail to the main body section in a manner where the sub-rail is releasably attached to said main body section, the improvement comprising:

convexly bulged sides of the main body section to decrease vertical stiffness and absorb vibrations.

10. A missile launcher according to claim 1, wherein the sides of the main body section are convexly bulged to reduce vertical stiffness and absorb vibrations.

* * * * *